US007789148B2

(12) United States Patent
Rayssiguier et al.

(10) Patent No.: US 7,789,148 B2
(45) Date of Patent: Sep. 7, 2010

(54) METHOD AND APPARATUS FOR CONSOLIDATING A WELLBORE

(75) Inventors: Christophe Rayssiguier, Melun (FR); Simon James, Le Plessis-Robinson (FR); Philippe Gambier, Houston, TX (US); Jean-Louis Saltel, Le Rheu (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 114 days.

(21) Appl. No.: 11/814,489

(22) PCT Filed: Jan. 27, 2006

(86) PCT No.: PCT/EP2006/000778

§ 371 (c)(1),
(2), (4) Date: Oct. 6, 2008

(87) PCT Pub. No.: WO2006/084597

PCT Pub. Date: Aug. 17, 2006

(65) Prior Publication Data

US 2009/0032257 A1 Feb. 5, 2009

(30) Foreign Application Priority Data

Feb. 10, 2005 (EP) ..... 05290306

(51) Int. Cl.
*E21B 33/127* (2006.01)
*E21B 33/138* (2006.01)

(52) U.S. Cl. ..... 166/285; 166/177.4

(58) Field of Classification Search ..... 166/287, 166/177.4
See application file for complete search history.

(56) References Cited

U.S. PATENT DOCUMENTS

| | | | | | |
|---|---|---|---|---|---|
| 2,079,830 | A | * | 5/1937 | Baker et al. | 166/142 |
| 2,796,134 | A | * | 6/1957 | Binkley | 166/207 |
| 3,102,599 | A | * | 9/1963 | Hillburn | 175/72 |
| 3,111,991 | A | * | 11/1963 | O'Neal | 166/207 |
| 3,130,787 | A | * | 4/1964 | Mason | 277/333 |
| 3,270,814 | A | * | 9/1966 | Richardson et al. | 166/291 |
| 3,295,603 | A | * | 1/1967 | Bagwell | 166/276 |
| 3,389,752 | A | * | 6/1968 | Lebourg | 166/285 |
| 3,419,080 | A | * | 12/1968 | Lebourg | 166/207 |
| 3,493,045 | A | * | 2/1970 | Bassani | 166/187 |
| 4,462,714 | A | | 7/1984 | Smith | |
| 4,971,152 | A | * | 11/1990 | Koster et al. | 166/277 |
| 5,337,823 | A | * | 8/1994 | Nobileau | 166/277 |
| 5,695,008 | A | * | 12/1997 | Bertet et al. | 166/187 |
| 5,833,001 | A | | 11/1998 | Song | |

(Continued)

*Primary Examiner*—Jennifer H Gay
(74) *Attorney, Agent, or Firm*—David Cate; Robin Nava; Jeff Griffin

(57) ABSTRACT

Methods and tools to consolidate a wellbore by displacing conventional cement slurry or any other settable fluid, without any permanent casing are useful. A bladder is inflated inside the bore to act as a mold and to form an annulus that can be filled by cement slurry or any other settable fluid. When the cement or the resin is set, the form is retrieved by straight pull; leaving a cement or resin sheath to support the formation without requiring any re-drilling. The sheath can be perforated if necessary (in the producing zone). Applications include without limitations temporary cementation of mono-diameter wells, through-tubing repair of an open hole, or cementation of a slotted liner in water, oil or gas wells.

17 Claims, 6 Drawing Sheets

U.S. PATENT DOCUMENTS

| | | | | |
|---|---|---|---|---|
| 5,842,518 | A | 12/1998 | Soybel | |
| 6,044,906 | A * | 4/2000 | Saltel | 166/187 |
| 6,102,120 | A * | 8/2000 | Chen et al. | 166/287 |
| 6,578,638 | B2 * | 6/2003 | Guillory et al. | 166/387 |
| 6,820,691 | B2 * | 11/2004 | Follini et al. | 166/291 |
| 6,868,910 | B2 * | 3/2005 | Corre et al. | 166/313 |
| 7,082,998 | B2 * | 8/2006 | Zamora et al. | 166/384 |
| 7,392,851 | B2 * | 7/2008 | Brennan et al. | 166/387 |
| 2003/0145992 | A1 * | 8/2003 | Corre et al. | 166/302 |
| 2006/0090905 | A1 * | 5/2006 | Brennan et al. | 166/387 |
| 2008/0135240 | A1 * | 6/2008 | Brennan et al. | 166/264 |
| 2008/0236835 | A1 * | 10/2008 | Rayssiguier et al. | 166/332.1 |
| 2009/0032257 | A1 * | 2/2009 | Rayssiguier et al. | 166/287 |
| 2009/0151929 | A1 * | 6/2009 | Saltel | 166/177.4 |
| 2009/0183875 | A1 * | 7/2009 | Rayssiguier et al. | 166/290 |
| 2009/0260817 | A1 * | 10/2009 | Gambier et al. | 166/285 |
| 2010/0025036 | A1 * | 2/2010 | Gambier et al. | 166/277 |

* cited by examiner

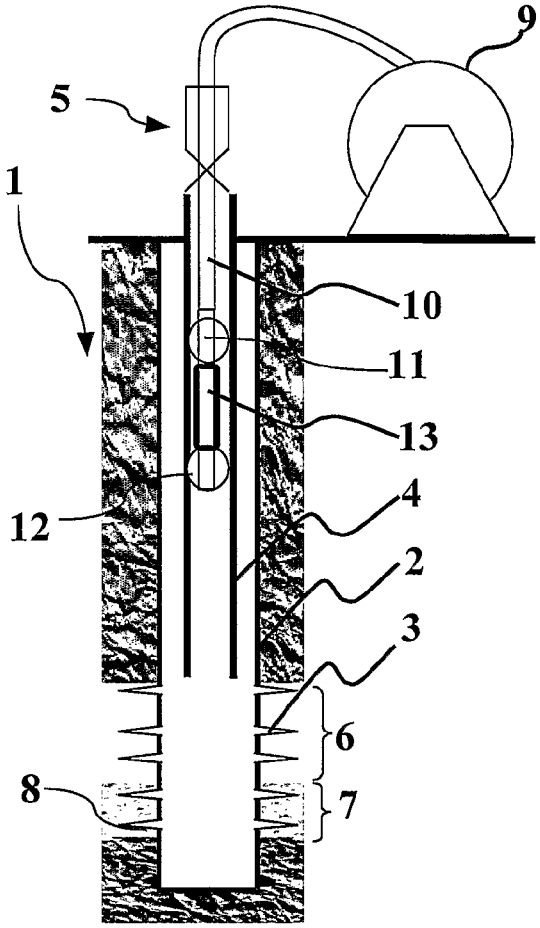
Figure 1-A
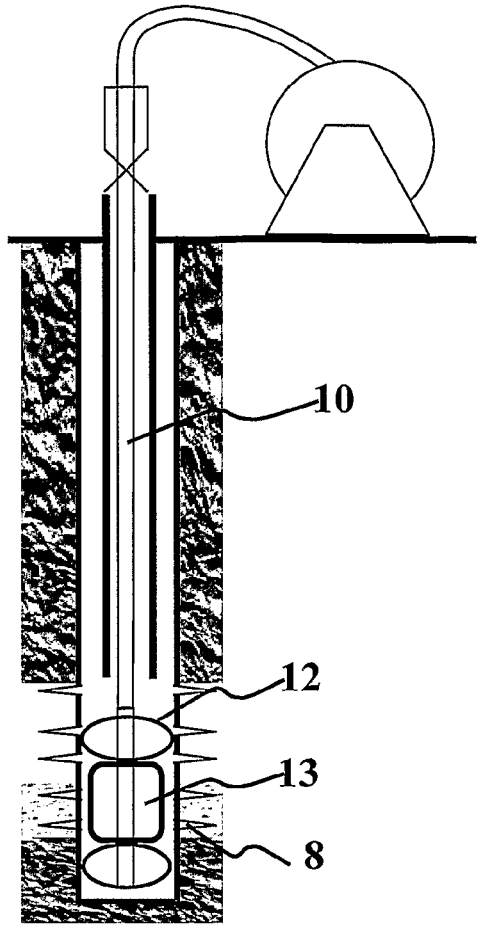
Figure 1-B

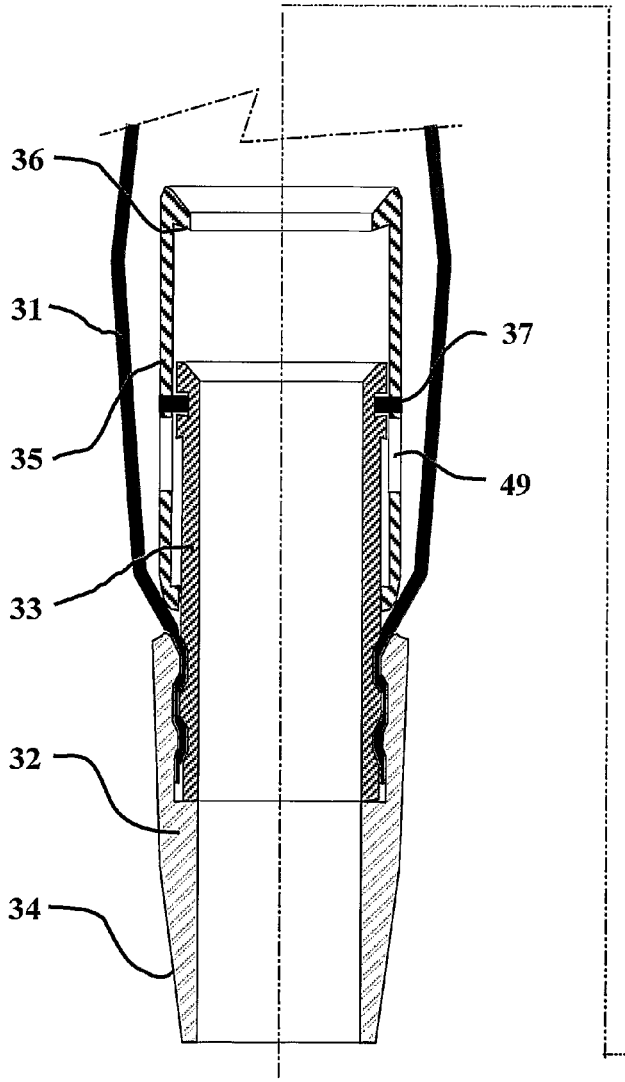
Figure 3-A
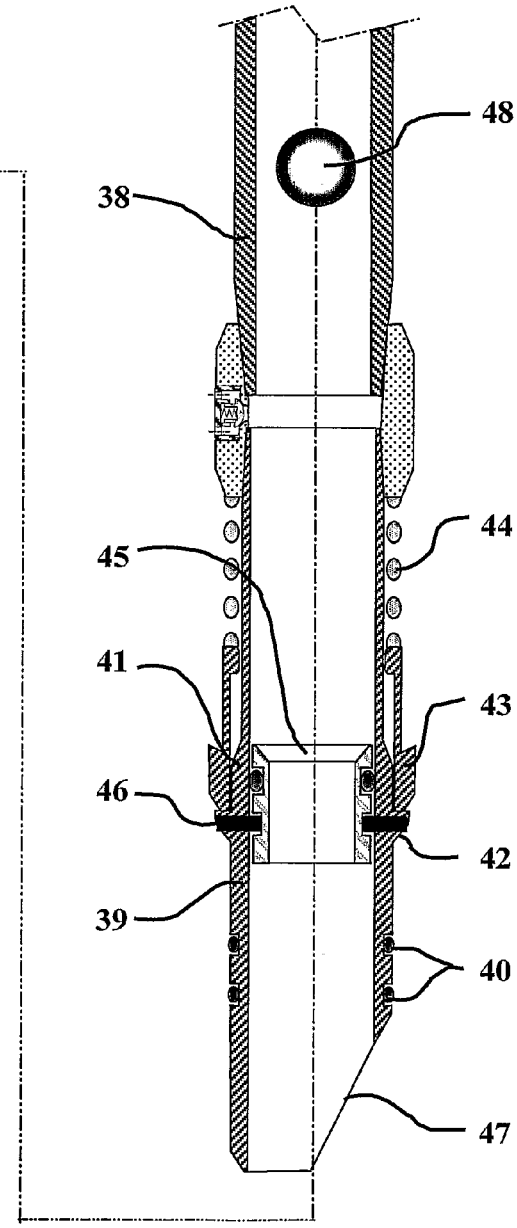
Figure 3-B

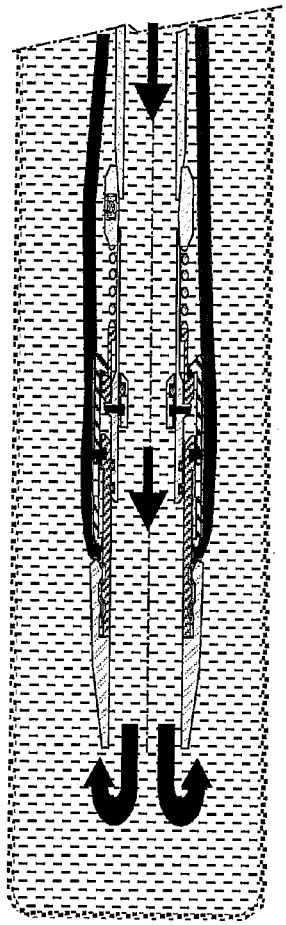
Figure 5-A
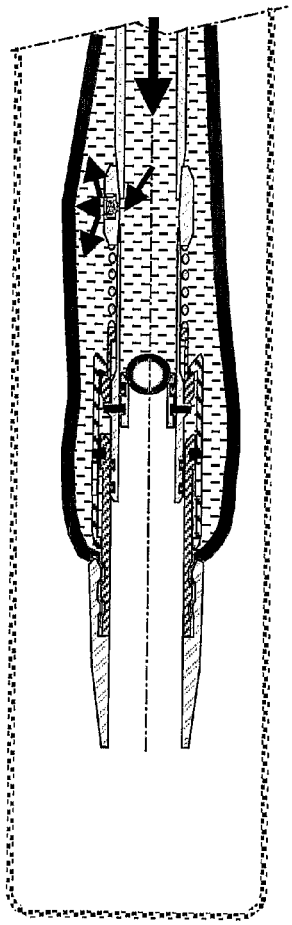
Figure 5-B
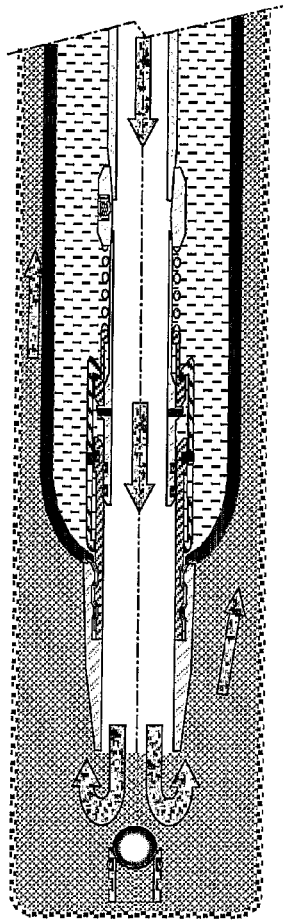
Figure 5-C
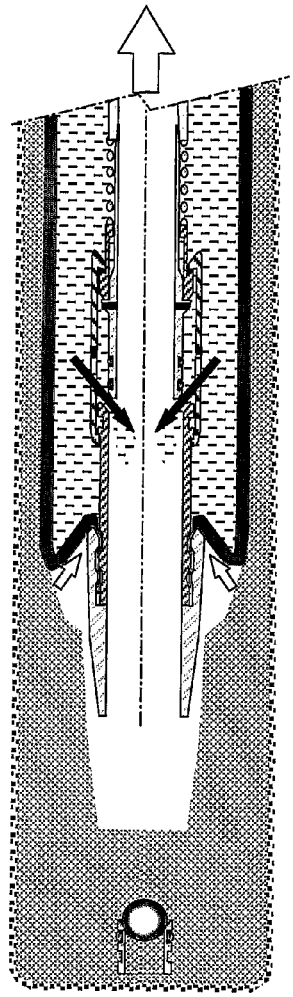
Figure 5-D
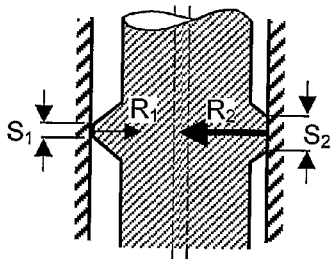
Figure 6A
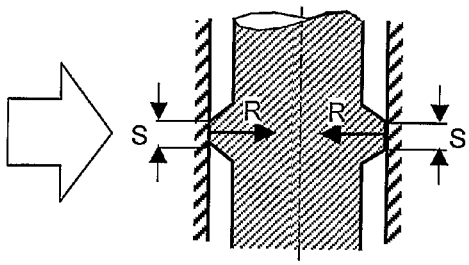
Figure 6-B

METHOD AND APPARATUS FOR CONSOLIDATING A WELLBORE

BACKGROUND OF THE INVENTION

1. Field of the Invention

The present invention relates to a method and a tool for at least a portion of a wellbore in a well penetrating a subterranean reservoir, such as for instance an oil and gas reservoir or a water reservoir.

2. Description of the Related Art

After drilling a well, the conventional practice in the oil industry consists in filling the well with a metal lining, a.k.a. casing. The casing is lowered down the hole and cement is pumped inside the casing and returns through the annulus where it is allowed to set. Lining the well aims at a dual purpose: preventing the bore walls from collapsing and isolating the various geological strata and thus, avoiding exchange of fluids between them.

Obviously, a casing cannot be installed once the well is completed, i.e. the production tubing is in place. This can be an issue in particular with so-called horizontal wells often left uncased to maximize production but that, as they age, could benefit from a casing to allow local treatments. Before the completion, it is also obvious that the maximum external diameter of any casing portion has to be smaller that the internal diameter of any previous casing section.

Even though the casing is made of a series of pipes connected end to end thanks to threading portions, in general, several sections of casing are required for lining a well. Indeed, during the entire drilling operation, the well is filled with a drilling fluid or mud. The mud cools the drilling tool and keeps the drilling debris in suspension to enable it to be evacuated to the surface. Another essential function of the mud is to ensure the safety of the well by providing hydrostatic pressure, which is higher than the pore pressure of the formation, thus preventing any inadvertent upflow of gas or other fluids. This pore pressure generally increases with the depth. On the other hand, this hydrostatic pressure cannot be so high that it fractures the rock. So, when the drilled section exceeds a certain length (or more precisely when the depth between the top and bottom exceeds a certain value), the upper part of the well has to be lined to allow the use of mud of higher densities to balance the pore pressure of the bottom part without fracturing the top portion of the well.

Since the well has to be cased starting from the surface, each series of casing must go through the casing already cemented, leading to telescopic pattern with a narrow section. Even though the depth pressure gradient is taken into account when designing a well, additional sections may be required for instance if the well intercepts poorly consolidated formations. If too many sections are needed, the bottom section may become too narrow for the drilling means, the completion equipment or production equipment.

U.S. Pat. No. 5,348,095 discloses a completion method including the use of casing of a ductile material that is plastically deformed to an enlarged diameter with a radial expander. Advantageously, this tube is continuous and thus, can be cemented. On the other hand, the expansion (up to 25%) is accompanied by shrinkage of the total length, leading to problems at the tube ends. Moreover, the load required for the expansion is very high.

To avoid excessive loads during the expansion and the length shrinkage, it has been proposed to use a liner with longitudinal slots as disclosed for instance in U.S. Pat. No. 5,667,011. The liner can be expanded with an expansion mandrel. During the expansion, the slots deform thereby maintaining a constant length. On the other hand, the openings prevent a conventional cementing placement with the settable fluid displaced downwards inside the casing and upwards outside the casing. When cementing is desirable, a full borehole is filled with cement and once the cement is set everywhere, the borehole is re-drilled. The cement may be harder to drill than the subterranean formation and this drilling may damage the liner. Moreover, the expansion rate remains limited and thus, this type of expandable casing cannot be run through production tubings due to their small inside diameter.

Another approach disclosed in U.S. Pat. No. 6,533,036 consists in reinforcing the wall with a cement coating without providing a casing. U.S. Pat. No. 6,533,036 proposes a tool including an injection module connected to a downhole reservoir for storing an activator and pumping from the surface a base fluid that is projected to the wall simultaneously with the activator to activate setting of the base fluid. A slip formwork, located near the activator is used to contain the cement until it sets. This technique requires the use of special cements, such as aluminate cement that cannot be mixed with regular cement, even in small quantities, and consequently raises logistic issues.

Hence it remains the need for alternative completion methods that would overcome some of the drawbacks abovementioned. It would thus be desirable to have techniques available for at least temporarily treating critical zones, such as poorly consolidated geological layers, to limit the duration and cost of interruptions to drilling, and to do so with no substantial reduction in the hole diameter.

SUMMARY OF THE INVENTION

According to the present invention, it is proposed a method of cementing a borehole comprising placing an expandable tubular bag surrounding a setting tube near the zone to be cemented, expanding the bag to a limited extent so that an annulus is formed between the bag and the borehole wall, pumping a settable fluid though the tube and into said annulus; allowing the fluid to set; deflating the bag and withdrawing the tube. Where the bag is made of a material that does not stick to cement, such a rubber, the bag can also removed with the setting tube.

Advantageously, the present invention can be carried out for cementing short or extended portion of wellbore. For instance, the invention can be used to repair a casing, and in this case, the bag will have a length of no more than a couple of casing units (10 to 40 meters). In that case, the bag can be placed around the setting tube before its insertion into the well with both the setting tube and the bag simultaneously run into the well. Where the bag length exceeds the standard length of a casing unit (40 feet or 13 m), the bag will be installed around a coiled tubing unit, and stored coiled.

Another deployment mode consists in first suspending the bag in the well from the surface and then, assembling it to a setting tool. This method may be used whatever the bag length is, the only restriction being that the top portion of the well is essentially vertical so that the flat bag does not catch the walls in a manner that could prevent its full deployment. In practice, this is not a real issue since "horizontal wells" typically consists of vertical well that substantially deviate from the vertical at a depth of 500 meters or more. In this case, the setting tool can be a coiled tubing unit or uncoiled pipes deployed from a drilling rig, as typically available for uncompleted wells.

According to a preferred embodiment, the bag inflation is constrained by a non-elastic (or essentially non-elastic) semirigid sheath surrounding the bag. Examples of such sheaths include metallic net or a cloth made for instance of glass fiber or highly resistant fibers such as aramid fibers. With such a rigid sheath, the formation of an annulus can be ensured even if the well has never been completed—or was first completed with a continuous casing.

According to a further embodiment, centralizing means is provided. In yet a preferred embodiment, the bag includes inflatable pads that create protrusions in contact with the wellbore (or an existing casing or slotted liner), and that leads to a self-centralization of the bag.

Depending on the deployment methods, the method of the invention is compatible with a standard rig as well as coil-tubing units and is thus appropriate for completing a well while or just after drilling or for intervening on existing wells, even though the production tubing has already been put in place. It is further compatible with any type of cementing fluids.

Applications of the present invention includes, without being limited to, temporary cementation of mono-diameter wells, lost circulation termination, cementation of slotted liners, cementation of horizontal wells, cementation of perforations, casing repair. Since the bag and the setting tool can be used even in very narrow or tortuous areas, the invention is particularly adapted for cementing junction, lateral branches or any types of zones that is barely reachable with a tube of relatively large diameter.

BRIEF DESCRIPTION OF THE DRAWINGS

Further characteristics, advantages and details of the invention become apparent from the description below, made with reference to the accompanying drawings which are given solely by way of example and in which:

FIGS. 1*a* and 1*b* schematically illustrate the principle of treating a short critical zone in a borehole using a first embodiment of the method according to the invention;

FIG. 3 shows a detail of the bladder lower extremity equipment with attachment means for the stinger and a stinger configured to fit into the attachment means of the bladder;

FIG. 5 shows key steps of the cementing process with the device of FIG. 4;

FIG. 6 shows the self-centralization of the bladder with the inflatable pads;

Figure 2:
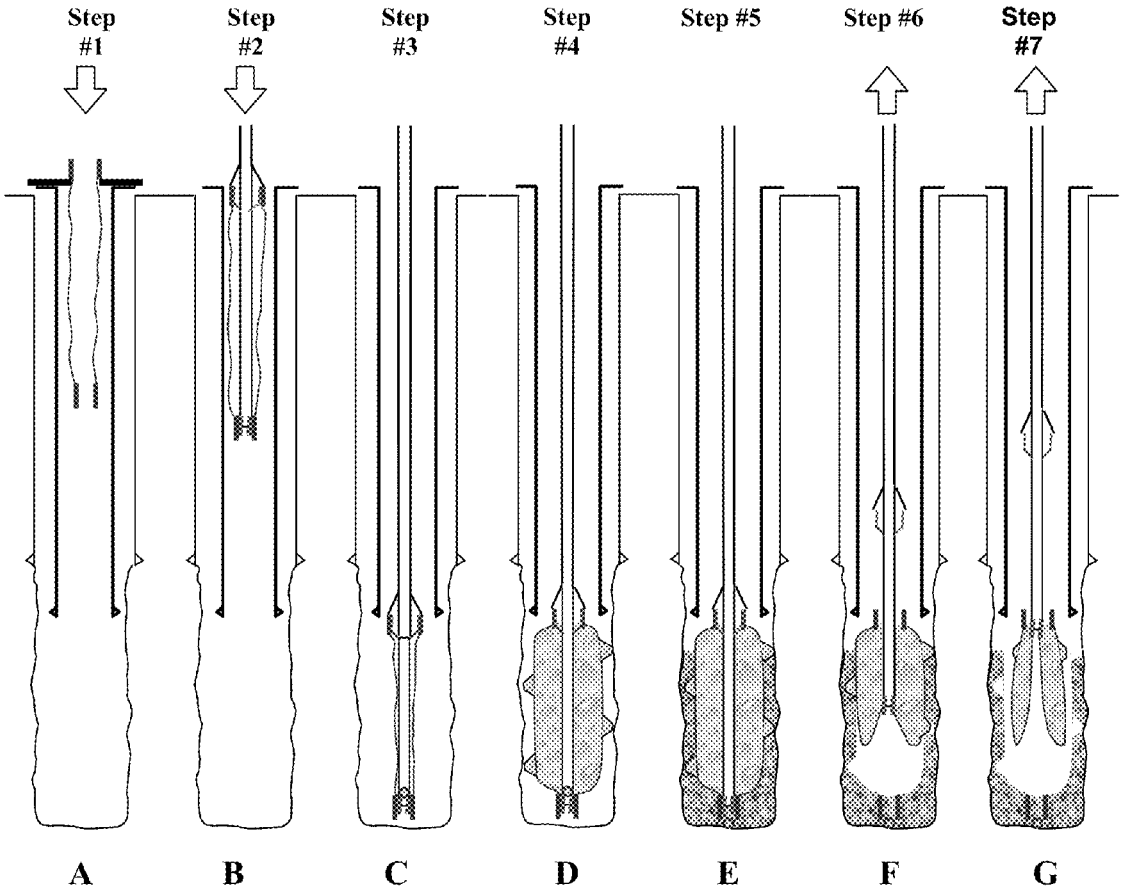
FIG. 2 (broken down in 7 sketches corresponding to 7 steps of the deployment) illustrates the second embodiment of the invention with the bag first deployed before being driven by a stinger.

To facilitate the following description, by convention, the different parts of the tools will be referred to as if the tools were deployed in a vertical well, so that the adjectives "upper" and "top" correspond to the portion of the tool nearest the surface, and the adjectives "lower" and "bottom" correspond to the other extremity of the tool, nearest the bottom of the well.

The basis of the invention is to create a temporary annulus using an inflatable bag or bladder. The bag preferably includes an external surface made of rubber, a material that poorly adheres to cement. Its structure may be similar to that of flat fire hoses. Its length may vary from a few meters to several hundred meters. Its diameter shall be expandable up to a value that is about 100% to about 500% the deflated value. Note that it is preferred that the initial diameter is relatively close to that of the setting pipe to avoid loose contact that could make it easier for the bag to catch the walls when put in place. Since the bag only provides a temporary limit for the cement and does not provide any isolation between two zones, as it is the case for instance with packers, it does not need to strictly follow a form like a wall and therefore, can be relatively easy to manufacture.

FIG. 1 is a schematized view that illustrates a first embodiment of the method according to the invention where the setting pipe is placed inside the bag at the surface. In this FIG. 1, the setting pipe is deployed with a coil-tubing unit. Since the bag assembly is prepared at the surface, either in a plant or at the oilfield location, this method is only appropriate for treating relatively short zones. Coil-tubing deployment is particularly suitable for already completed wells since it allows through-tubing installation as in the illustrated case but this embodiment can also be carried out with a deployment with conventional rig equipment.

In the case illustrated FIG. 1-A, a well 1 in a subterranean formation was completed with a cemented casing 2 provided with perforations 3 in the production zone to allow the production fluids to enter the well and to rise to the surface through production tubing 4. At the surface, the wellhead is fitted with a Christmas tree 5 that provides a set of valves, spools, pressure gauges and chokes that ensure security and allow to intervene on the completed well.

Such an intervention may be required for instance if water production increases, for instance due to a displacement of the interface between the oil-producing zone 6 and the water-producing zone 7, as it is often the case with aging reservoir. In this case, it is desirable to plug the perforations 8 now facing the water-producing zone 7.

A coil-tubing reel 9 is provided to the field location and the coil-tubing 10 is downloaded through the production tubing. A setting tool according to the invention is attached to a coil-tubing end and includes a conduit 11 carrying centralizers 12 and a deflated bag 13. Ports (not shown) are provided to allow fluid communications between the bag inner part and the conduit. Safety valves (also not shown) are also provided at the extremity of the conduit so that fluid—such as drilling fluid—can be pumped through the coiled tubing into the space surrounding it.

As shown in FIG. 1-B, once the setting tool is placed near the area to be treated, the centralizers 12 are deployed. The communication paths between the inner conduit and its exterior are closed, for instance by means of a ball launched from the surface so that the bag 13 is inflated and creates an annulus along the uncased portion of the borehole. At that stage, a separation pig is introduced from the surface into the coiled tubing pushed by the cement slurry. Once the pressure created by the cement exceeds a certain threshold, the safety valve passages are opened and cement is pumped into the annulus to isolate the perforations. The cement is allowed to set. Next, the coil-tubing can be pulled out, and the well is now ready for resuming production.

FIGS. 2-5 shows an alternative design that can accommodates almost any length of bag. When contemplating bag placement around the setting tool as in the embodiment shown FIG. 1, it must be considered that the maximum length than can be handled on a rig is about 100 ft, and a surface transportation is usually limited to 40 ft. So this is a serious length limitation to any assembly prepared at the surface; indeed such a limitation is typically not compatible with a cement job beyond a simple repair.

This limitation is overcome with the suggested procedure that consists in lowering the bladder alone in the well, then to assemble the stinger joint by joint and run it inside the bladder. The stinger insert makes the bladder rigid so that it can be pushed down by the weight of the vertical section when it is run downhole in a deviated or horizontal where the gravity would not be sufficient. The stinger is preferably made of a light material such as fiberglass whose relative density in mud fluids is very low.

FIG. 2 illustrates the sequence of events in this configuration. In step 1, the bladder, which can have a length of up to several hundred meters, is lowered into the well, hanging from the surface, and still entirely contained in the vertical part of the well. A pulley can make the deployment easier. Even if the well is a so-called horizontal well, the top section near the surface is usually vertical, making this step easy since the gravity avoids the formation of creases. In step 2, the stinger (with a latch at both extremities) is lowered into the form. Then the lower latch engages the bladder extremity and it is automatically latched. If necessary, the upper extremity of the bladder is cut at the correct length, then attached to the upper latch. The assembly can be small enough to be run through a production tubing; with the driving force provided by either coil tubing or a series of threaded tubes powered with a conventional rig. With the bladder and the stinger providing some rigidity attached to it, the assembly is run down to the well, eventually in horizontal sections. During this operation, mud—or any weighted fluid compatible with the formations—can be pumped through the tubing and the stinger, and it returns back to the surface via the annular space created by the production tubing and the setting tube.

In step 3, the assembly is now located at the right position. A ball or dart is launched to plug the stinger. With the mud circulation blocked, the mud starts to inflate the bladder through a check valve. The form is centralized and its diameter is limited to create the desired annulus as shown with step 4.

In step 5, due to the pressure build-up, the ball and ball seat are ejected, acting as a relief valve to limit the pressure trapped in the bladder. Cement slurry fills the annular. The whole assembly is left in the well to allow for cement setting.

Step 6, with the cement now set, the latches are released by straight pull, which opens venting ports: mud is no longer trapped in the form The whole assembly can now been pulled out of the hole as illustrated in step 7. The bladder is pulled from the bottom, which reduces the required load, as the cement/rubber adherence is overcome by peeling the bladder away from the cement.

Now that the overall sequence of events has been described, various preferred components will be further explained in reference with FIGS. 3 to 7.

FIG. 3 shows a detailed view of the bladder lower extremity (FIG. 3-A) and the stinger latch (3-B).

The bladder 31 is equipped with latching means. The latching means includes a mortise unit 32 cooperating with a tenon joint 33 along a corrugated portion where the bladder is squeezed. The mortise 32 and the tenon joint 33 are preferably made of steel so that the latching means weight facilitates the deployment of the bladder. In addition, the mortise has a lower chamfer 34 also to facilitate the deployment and the retrieval once the cement is set.

A tube 35 with locking fingers 36 and including venting ports 49 is attached to the tenon unit through shear pins 37.

As shown in FIG. 3*b*, the lower extremity of the stinger 38 is also equipped with attachment means. This means includes a latch body 39 with one or several seals 40 and a mule shoe shape 47 to help engaging the bladder attachment. The body 39 includes stop means 42 and shoulder 41 to secure an expandable collet 43.

A spring 44 is mounted around the body 39, between the collet 43 and the lower extremity of the stinger 38. The body is further equipped with a ball seat 45, secured with shear pins 46. A ball 48 or a dart launched from the surface can thus land on that seat and plug the stinger.

Figure 4:
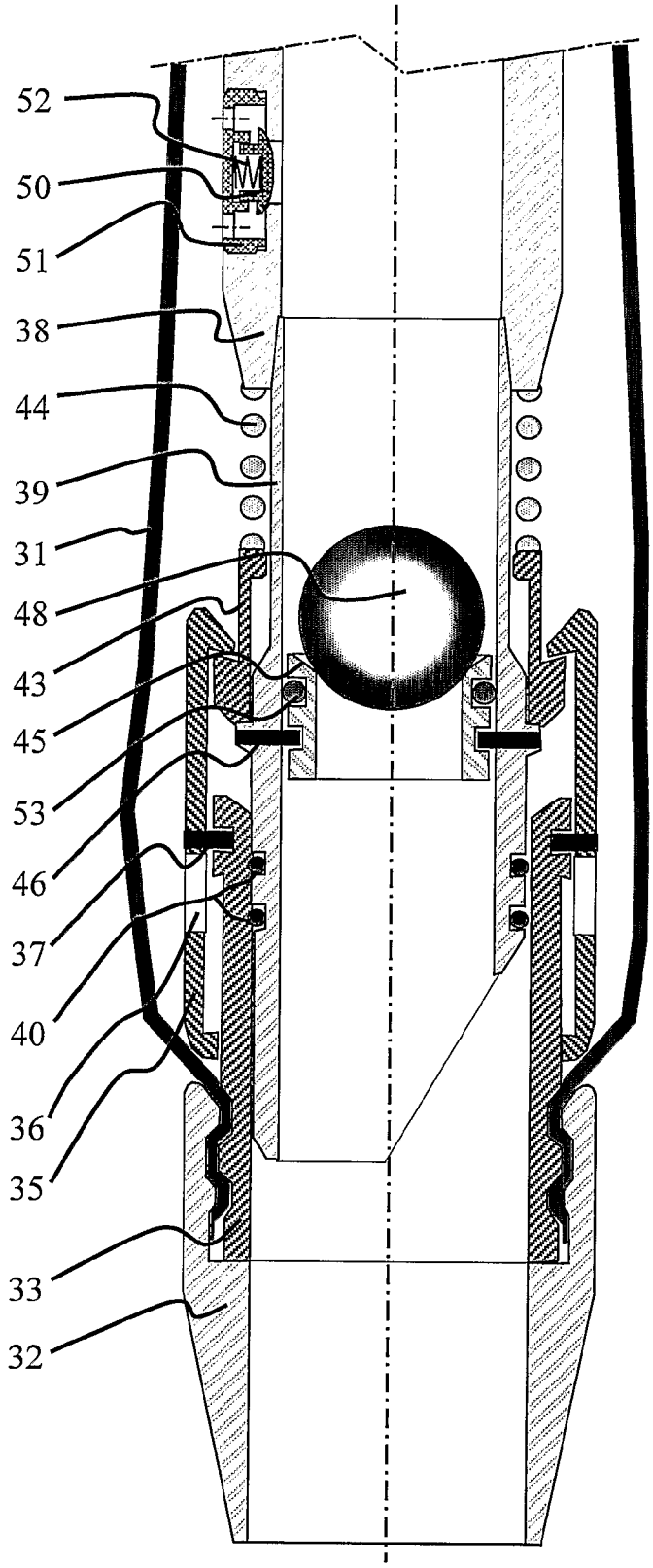
FIG. 4 shows the bladder and stinger of FIG. 3 with the bladder attached to the stinger.

FIG. 4 shows the bladder attached to the stinger. In this FIG. 4, it can further be seen that the stinger includes means to inflate the bag includes a check valve 50, a check valve holder 51 and a check valve spring 52.

With FIG. 4, it may be noted that the collet 43 snaps into the tube 35 while the seals 40 ensure sealing between the bladder assembly and the stinger assembly.

Those skilled in the art will understand that the variant described above is only one of the possible designs. It would be also understood that the upper parts of the bladder and of the stinger can be equipped with similar attachment means that do not need to be further described.

Referring to FIG. 4, a few features of the described arrangement can be emphasized. First, latching is automatic: when the collet 43 bottoms on top of the tube 35, the stinger 38 and the body 39 continue to go down, compressing the spring 44. Once the spring is totally compressed, the fingers of the collet 43 can collapse as their large chamfer acts as a ramp and the body shoulder 41 is no longer located behind the fingers. When the fingers are entirely collapsed, the spring 44 pushes them down to engage the tube 35, until they expand again in its recess 36. Whenever the latch is under tension, the body 39 moves upward until its shoulder 42 stops on the collet. At that moment the fingers can no longer collapse and their external profile (usually a negative angle shoulder) catches the tube upper shoulder 36: the system is latched.

The shear pins 46 secure the seat 45 in the latch body 39. The seat 45 is sealed inside the body 39 with a seal 53, then the ball/dart 48 seals inside its bore. Thus the pressure can rise on top of the ball/dart, creating a load that pushes the seat downward and tends to shear the pins. The shear value is adjusted so that the seat and the ball/dart are ejected before reaching the maximum working pressure in the bladder 31. Once the seat is ejected, the circulation can be resumed through the tool bore into the annulus, while the pressure is maintained trapped in the bladder thanks to the check valve 50 located in the thickness of the stinger 38. That check valve is the only filling port for the bladder. Of course, several check valves can be implemented to increase the inflation speed of the bladder.

The stinger 38 is latched onto the bladder attachment by the tube 35. Shear screws 37 maintain the tube 35 in a position such that the seals 40 located at the bottom of latch body 39 engage the attachment internal bore. So the volume between the bladder 31, the stinger 38 and the latch body 39 is sealed. But the shear screws 37 can be sheared by a straight pull on the stinger 38 from the surface. Once they are sheared, the tube 35 moves upward until its lower shoulder butts against the upper shoulder of the attachment 33. In this new position, the seals 40 are disengaged from the attachment seal bore, and the venting ports 36 of the tube 35 make a communication path to the internal bore, bleeding down the fluid that was trapped in the bladder. Consequently the bladder is now emptying, and the straight pull on the lower attachment can turn inside out, breaking the adherence on the cement.

The sequence of valves closure and openings will be further understood with reference to FIG. 5 where arrows have been added to schematize the main flow. In FIG. 5A, the assembly is put in position downhole the well. At this stage, the bladder is still loose. The whole assembly lies in mud (or other service fluid) that can circulate through the setting tubing, the stinger and return to the surface along the bladder. In FIG. 5B, the assembly is at desired depth and a ball has been dropped from the surface. Since mud pumping continues, the pressure increases in the stinger and the check valve opens, allowing for bag expansion. In FIG. 5C, the bag is fully expanded. The pressure builds up in the stinger and the bag, until it breaks the shear pins that used to maintain the ball seat so that this ball seat and the ball are expulsed and fall. At that stage, circulation can be resumed and the pressure stays trapped inside the bladder, thanks to the check valve. Cement is pumped from surface until it fills the annulus. Once the cement is set, the stinger is pulled back to the surface. Since fluid circulation has stopped, the bladder pressure is now greater than the pressure inside the stinger, which leads to the bladder deflating, favoring its withdrawal outside the well.

As mentioned above, centralization of the bladder is preferred. Conventional centralization means can be used for short bladder lengths, such as the centralizing blades at both extremities of the bladder, as shown on FIG. 1. But the centralization issue becomes more crucial as the bladder length increases and conventional means are no longer efficient. According to a preferred embodiment of the present invention they are not required if the bladder is equipped with inflatable pads as illustrated FIG. 6. With the bladder inflating, the pads come in contact with the wellbore and ensure the bladder is correctly centralized in the open hole so that the thickness of the annulus is uniform.

To achieve a self-centralizing effect, a conical shape can be used for the inflatable pads. When the form is not centralized correctly (see FIG. 6-A), the pads on one side are more collapsed than on the opposite side. The conical shape makes that the surfaces in contact with the formation (S1 and S2) are different, so the internal pressure P creates two different reactions (R1 and R2), tending to centralize the form until the surfaces in contact are symmetrical (S) and the reactions are equal to R (see FIG. 6-B).

$$S_1<S_2 \Rightarrow R_1=P\cdot S_1<R_2=P\cdot S_2$$

In addition, the pads should be removed after the cement is set, and a conical shape will help to extract them from the cement sheave. In order to minimize the cement adherence, the pads can preferably be made of rubber or any equivalent material.

In yet a further embodiment, expansion control means may be provided. If the density of the pads (quantity per area) is high enough, the pads can limit the expansion of the form, creating a gap between the form and the well bore. The thickness of this gap is important, as the cement slurry will fill it.

Alternatively or in addition, the bladder can be equipped with a device to limit its expansion to a given diameter, within a given range of internal pressure. This can be performed with a device that has a controlled and limited deformation for instance due to the nature of the material and/or due to the geometry of a net. This device initially covers the bladder, or is an integral part of it. For example, this sheath can be a metallic net similar to a chained mail or a cloth such as an aramid braid.

When the form inflates, the sheath expands until the wires or the threads are under tension at an angle such that it cannot expand anymore. For example, a given braid will accept a maximum angle of 57°, corresponding to a balance between hoop, radial and longitudinal stresses. In that position, the sheath reaches its maximum diameter and it prevents the form to increase anymore, at least until it bursts.

By selecting the maximum diameter of the sheath smaller than the diameter of the hole, it is possible to control the thickness of the annulus, so the thickness of the cement sheath. The diameter of the inflated form can be known accurately for a relatively wide range of pressure.

Figure 7:
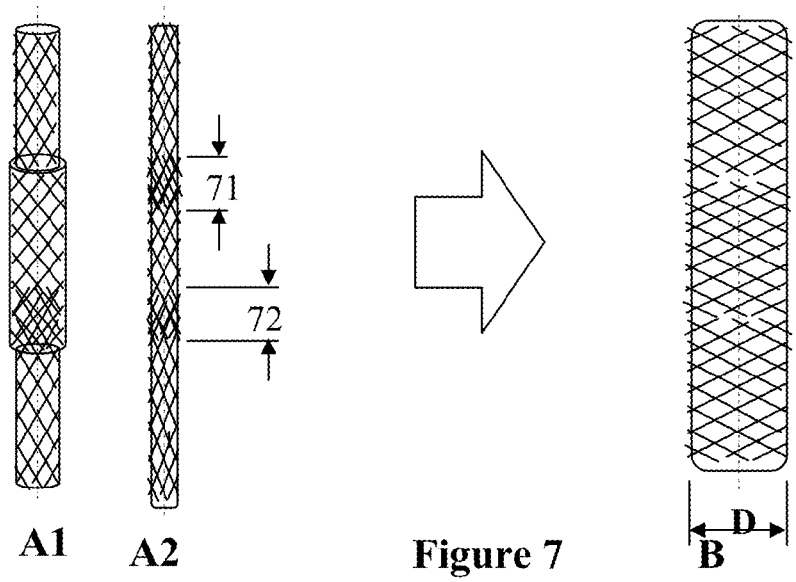
FIG. 7 shows a wire sheath suitable for limiting the bladder expansion.

As the sheath is made of rigid material, its diameter increase is linked to shrinkage of the overall length. In order to avoid obtaining uncovered areas of the inflatable form, the sheath can be made of several elements that overlap in the initial position, in such a way that there is almost no more overlap nor gap between the elements after inflation. The FIG. 7 illustrate this concept and show the braid in initial (collapsed) position (FIG. 7-A) with overlaps 71, 72 and in extension (FIG. 7-B), defining a fixed diameter D.

Figure 8:
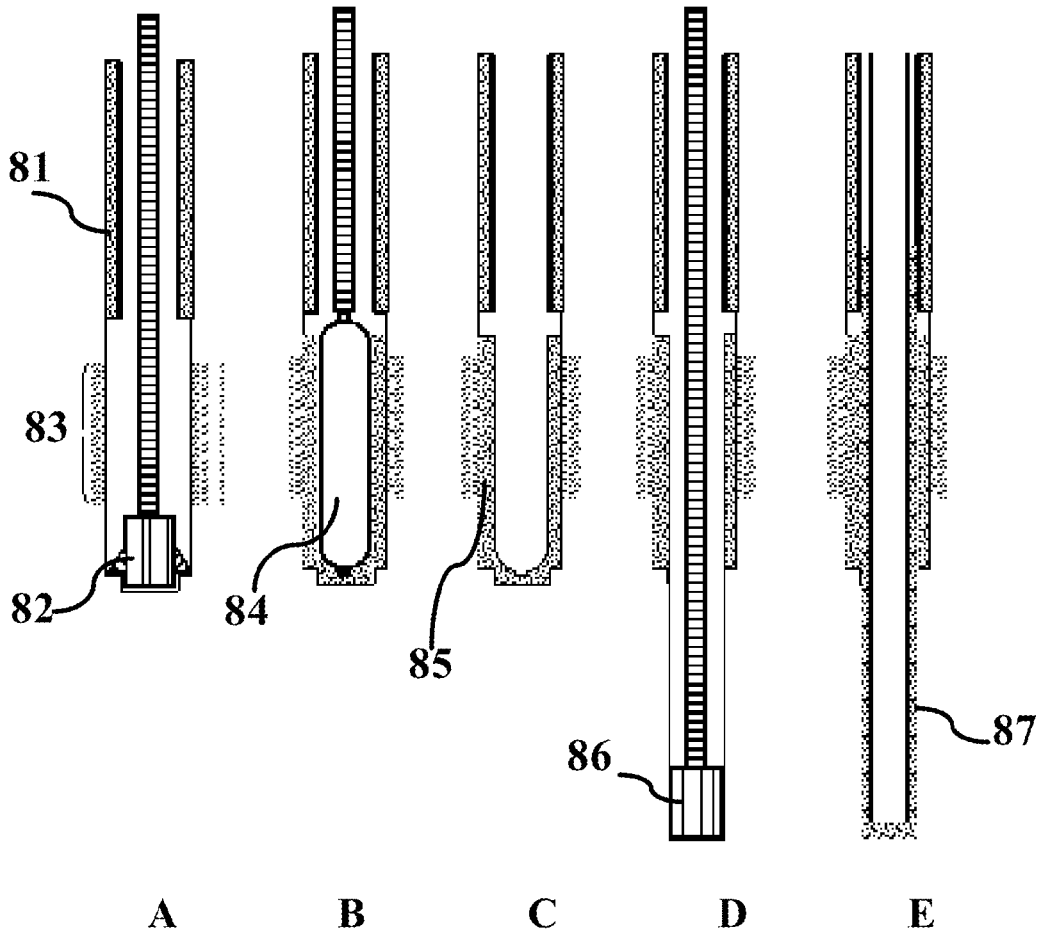
FIG. 8 shows a method of cementing a whole bore with the method according the invention.

As it has been mentioned before, the method of the invention can be applied to multiple types of well intervention. One type of particular interest is the temporary treatment of areas that need to be consolidated to allow further drilling. This is exemplified FIG. 8. FIG. 8-A is a schematic view of a well having a first cased portion. Drilling has resumed with underreamer 82 to minimize the drop in diameter when it is found that the well has intersected a weak formation 83 that risks to collapse, thereby preventing further drilling without consolidating the formation.

At this stage, as illustrated FIG. 8-B, a cement job is carried out with the method of the invention using an inflatable bag 84. With the cement 85 set, the inflatable bag is removed (FIG. 8-C). Drilling can be resumed (FIG. 8-D), for instance with conventional drilling tools 86 with only a minimal length of cement (corresponding to the height between the bag bottom and the well bottom) that needs to be re-drilled before getting a full mono-bore well. Once the total section has been drilled, a final primary cementing job can be done by conventional means with a new portion of casing 87 put in place (FIG. 8-E).

Beyond this application of temporary cementation of mono-diameter wells, the invention is also particularly suitable for through-tubing repair of an open hole, or cementation of a slotted liner in water, oil or gas wells, without any further drilling after cementing.

Another application is sand control. In this latter case, the cement (or another setting fluid) will be designed to be permeable after setting for the formation fluids to go through the reinforced wall. In the sand control application, a slotted liner will typically be used though it is not a requirement.

Moreover, even though the description has been made with reference to cement as setting fluid, the invention can also be carried out with other type of setting fluid such as resins for instance. It is also possible that the set material is permeable (permeable cement or resin)

The invention claim is:

1. A method of cementing a borehole comprising placing an expandable bag surrounding a setting pipe near the zone to be cemented, expanding the bag to a limited extent so that a temporary annulus is formed between the bag and the borehole wall, pumping a settable fluid though the setting pipe and into said annulus; allowing the fluid to set; deflating the bag and pulling to retrieve the setting pipe, wherein the bag is first lowered into the well, while hanging from the surface and then attached to a setting pipe including a stinger provided with latches at both extremities.

2. The method according to claim 1, further including the step of retrieving the bag while retrieving the setting pipe.

3. The method according to claim 1, wherein the bag is made of rubber.

4. The method according to claim 1, wherein a sheath made of substantially non-elastic material is provided around the bag to limit the bag expansion.

5. The method according to claim 1, wherein centralizers means is provided for the inflated bag.

6. The method according to claim 1, wherein the bag is positioned around the setting pipe prior to being put into the well.

7. The method according to claim 6, wherein the setting pipe is deployed through coil-tubing.

8. The method according to claim 6, wherein the setting pipe is deployed through a conventional rig.

9. The method according to claim 1, wherein the bag is cut at a length adapted to the treatment envisaged before being attached to the setting pipe.

10. A method of repairing a portion of casing including cementing a sheath along the casing according to the method as claimed in claim 1.

11. A method of cementing a slotted liner including cementing a sheath along the casing according to the method as claimed in claim 1.

12. A method of consolidating a well formation comprising providing a further reinforcement sheath along the borehole according to the method as claimed in claim 1.

13. The method of claim 12 wherein the further reinforcement sheath is made of permeable cement or permeable resin.

14. A method of cementing a borehole comprising lowering an expandable bag into a well while hanging the bag from the surface and then attaching a setting pipe, including a stinger, to an inner surface of the bag and then placing the bag surrounded by the setting pipe near the zone to be cemented, said stinger being provided with latches at both extremities, expanding the bag to a limited extent so that a temporary annulus is formed between the bag and the borehole wall, pumping a settable fluid though the setting pipe and into said annulus; allowing the fluid to set; deflating the bag and pulling to retrieve the bag and the setting pipe.

15. A method of repairing a portion of casing including cementing a sheath along the casing according to the method as claimed in claim 14.

16. A method of cementing a slotted liner including cementing a sheath along the casing according to the method as claimed in claim 14.

17. A method of consolidating a well formation comprising providing a reinforcement sheath along the borehole according to the method as claimed in claim 14.

* * * * *